US006640956B1

(12) United States Patent
Zwieg et al.

(10) Patent No.: US 6,640,956 B1
(45) Date of Patent: Nov. 4, 2003

(54) METHOD OF COIN DETECTION AND BAG STOPPING FOR A COIN SORTER

(75) Inventors: Robert L. Zwieg, Watertown, WI (US); Robert F. Fredrick, Watertown, WI (US); John P. Grajewski, Palmyra, WI (US); John A. Kressin, Watertown, WI (US); Thomas S. Murphy, Lake Mills, WI (US); Jon R. Stieber, Oconomowoc, WI (US)

(73) Assignee: De La Rue Cash Systems, Inc., Lisle, IL (US)

( * ) Notice: Subject to any disclaimer, the term of this patent is extended or adjusted under 35 U.S.C. 154(b) by 299 days.

(21) Appl. No.: 09/654,632

(22) Filed: Sep. 5, 2000

(51) Int. Cl.[7] ..... G07D 5/00

(52) U.S. Cl. ..... 194/328; 194/215; 194/216; 194/334; 194/302; 194/342; 453/3; 453/4; 453/30; 453/40; 453/49; 453/57; 453/58

(58) Field of Search ..... 194/328, 207, 194/334

(56) References Cited

U.S. PATENT DOCUMENTS

| | | | | |
|---|---|---|---|---|
| 3,939,954 A | | 2/1976 | Collins | |
| 4,088,144 A | | 5/1978 | Zimmermann | |
| 4,249,648 A | | 2/1981 | Meyer | |
| 4,577,744 A | | 3/1986 | Doucet | |
| 4,646,904 A | | 3/1987 | Hoormann | |
| 4,717,006 A | | 1/1988 | Chapman et al. | |
| 5,230,653 A | | 7/1993 | Shinozaki et al. | |
| 5,299,977 A | | 4/1994 | Mazur et al. | |
| 5,429,550 A | | 7/1995 | Mazur et al. | |
| 5,453,047 A | | 9/1995 | Mazur et al. | |
| 5,474,497 A | | 12/1995 | Jones et al. | |
| 5,480,348 A | | 1/1996 | Mazur et al. | |
| 5,514,034 A | | 5/1996 | Jones et al. | |
| 5,525,104 A | | 6/1996 | Adams et al. | |
| 5,564,978 A | | 10/1996 | Jones et al. | |
| 5,630,494 A | | 5/1997 | Strauts | |
| 5,992,602 A | | 11/1999 | Zwieg et al. | |
| 6,017,270 A | * | 1/2000 | Ristvedt et al. | 453/5 |
| 6,042,470 A | * | 3/2000 | Geib et al. | 453/10 |
| 6,328,150 B1 | * | 12/2001 | Hibari | 194/317 |

FOREIGN PATENT DOCUMENTS

EP 0 683 473 A2 11/1995

* cited by examiner

*Primary Examiner*—Donald P. Walsh
*Assistant Examiner*—Jeffrey Shapiro
(74) *Attorney, Agent, or Firm*—Quarles & Brady LLP

(57) ABSTRACT

A coin handling machine (10) has a coin sorting member (12) with a plurality of sorting openings (15, 16, 17, 18, 19, 20) by which respective denominations of coins (14) are sorted, having a coin driving member (21) with webs (22) for moving the coins to the coin sorting openings (15, 16, 17, 18, 19, 20), having a motor (60) coupled to the coin driving member (21), and having a brake (65) for stopping the motor (60), the coin handling machine (10). A coin imaging sensor (40) optically images at least a portion of a coin (14) and for transmitting dimensional data for identifying coins by denomination. A main controller (120) receives said dimensional data and counts each coin for bag stopping purposes separate from the counts maintained for totalizing the sorted coins. The controller (120) transmits signals to at least reduce the speed of the motor (60) when a bag count limit is reached for a respective denomination. Detectors (**15*b*, 16*b*, 17*b*, 18*b*, 19*b* and 20*b*) are provided adjacent the sorting openings (15, 16, 17, 18, 19, 20**) for detecting a last coin as it is sorted and moved into a bag.

20 Claims, 9 Drawing Sheets

FIG. 5A
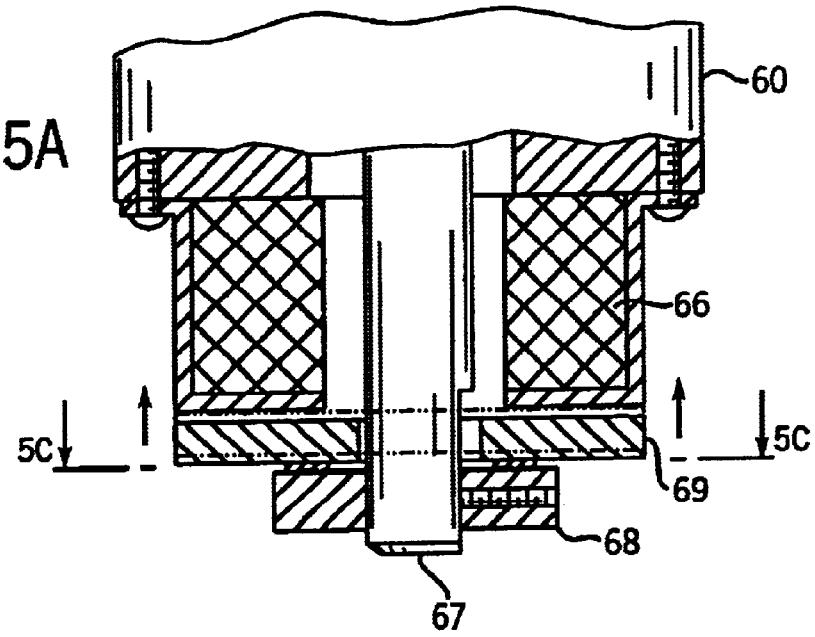
FIG. 5B
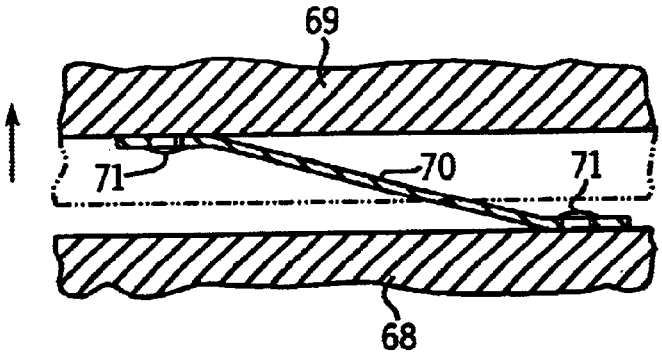
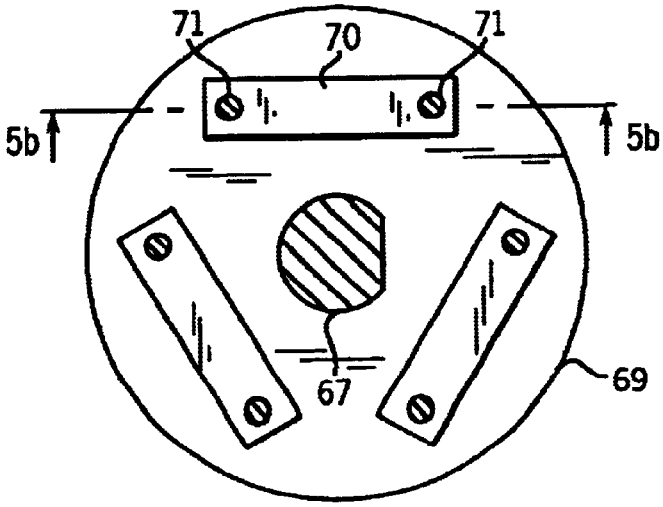
FIG. 5C

METHOD OF COIN DETECTION AND BAG STOPPING FOR A COIN SORTER

TECHNICAL FIELD

The invention relates to coin processing equipment and, more particularly, to coin sorters.

BACKGROUND ART

Coin sorters are used to sort and collect coins by denomination, such as penny, nickel, dime, quarter, half and dollar in the United States. Other denominations may be handled in countries outside the United States. In coin sorters, it has been the practice to attach bags or coin receptacles to collect the coins for respective denominations. As used herein the term "bags" shall be understood to include all types of removable receptacles used to collect coins by denomination. The bags are sized and defined to hold a certain number of coins, such as 5000 pennies or 2000 quarters. This number or limit on coins in a bag is referred to in the technical field as a "bag stop".

As the coins are being sorted, there is the problem of one of the bags becoming filled to the limit, at which time either the machine has to be stopped, or another bag switched into place to receive more coins of that denomination.

One method of counting coins and stopping the coin sorter based on bag limit counts is disclosed in Jones et al., U.S. Pat. Nos. 5,514,034; 5,474,497 and 5,564,978. In these patents, the coin sensors are placed outside the exit channels for counting the coins after they are sorted.

Other methods for sensing and counting coins for bag stopping are provided in Mazur et al., U.S. Pat. Nos. 5,299,977; 5,429,550; 5,453,047 and 5,480,348. In the Mazur '977 patent, the sensors for totaling coin counts are located in each exit channel, so that the coins are effectively sorted before they are counted. In the Mazur '550 patent, one of the sorting methods involves sensing the coins upstream of the sorting exits and monitoring the angular movement of the disk using an encoder. In the Mazur '550 patent, mechanical contact sensors are disclosed as being positioned at a certain position relative to the width of a coin to detect the leading and trailing edges of a single denomination, or of less than all denominations, by physically contacting the coin. In one example, a single contact sensor is used in conjunction with an encoder which tracks angular movement of the disc to calculate a chord length of each coin to detect the denomination.

In the prior art such as Mazur '550 patent, there has been a pre-warn sensing of the fifth last coin, and then a motor stopping sequence involving, a first stop, a slow speed jog and a final stop. As used herein the term "exact bag stop" means a bag stopping action which would cause the last coin for a denomination to be collected in a bag (or other receptacle).

The present invention is designed to provide a novel and improved approach for detecting coins and bag stopping, including stopping at exact bag stops. The invention is disclosed as an enhancement to a sorter of the type shown and described in Zwieg et al., U.S. Pat. No. 5,992,602 and offered commercially under the trade designation, "Mach 12," by the assignee of the present invention.

In this prior coin sorter, coins were identified by using an inductive sensor to take three readings as each coin passed through a coin detection station and these readings were compared against prior calibrated readings for the respective denominations.

Optical sensing of coins in coin handling equipment has been employed in Zimmermann, U.S. Pat. No. 4,088,144 and Meyer, U.S. Pat. No. 4,249,648. Zimmermann discloses a rail sorter with a linear photosensing array. Zimmermann does not disclose repeated scanning of the coin as it passes the array, but suggests that there may have been a single detection of the widest part of the coin. Zimmermann also does not disclose any processing of coin sensor signals. In response to detection of a number of coins Zimmermann operates an electromagnet to clamp down on a coin on a belt to stop movement of the coins. Zimmermann does not disclose any manner of braking a motor or conveying the last coin to a coin bag or receptacle.

Meyer, U.S. Pat. No. 4,249,648, discloses optical imaging of coins in a bus token collection box. Meyer does not fully describe, however, the resulting operations after a limit number of a coin denomination is reached.

SUMMARY OF THE INVENTION

The invention relates to a method and apparatus for utilizing optical imaging to rapidly count coins before they are sorted, and upon reaching a bag stop limit, either reducing speed or stopping a motor that causes movement of the coins in a coin sorting machine.

The method includes optically imaging at least a portion of each coin at a location upstream from sorting openings for sorting the coins and generating dimensional data for each respective coin; using the coin dimensional data for counting the coins by denomination for bag stopping purposes before said coins are sorted and counted for totalizing purposes; limiting further movement of the coins when said optical imaging produces data indicative of a bag stop limit being reached for a respective denomination; and detecting a last coin as it moves through a respective sorting opening.

The invention is applied in one preferred embodiment to a coin sorting machine having a coin sorting member with a plurality of sorting openings by which respective denominations of coins are sorted, having a coin driving member for moving the coins to the coin sorting openings, having a motor coupled to the coin driving member, and having a brake for stopping the motor.

The invention further provides a controller for receiving coin diameter data and counting each coin for bag stopping purposes separate from the counts maintained for totalizing the sorted coins. A main controller stores bag stop limits. When a bag stop limit is reached for a respective denomination, the main controller then transmits signals to stop, or reduce the speed of, the motor driving the coin sorting assembly.

The present invention is also capable of providing exact bag stop limits, where the machine is stopped or slowed down as the last coin in a bag is sorted into the bag.

In a further aspect of the invention, the coin sorting machine is stopped if the bag stop limit is reached for the denomination with a sorting aperture closest to the sensor. If the bag stop limit is reached for a denomination with a sorting aperture further along the sorting path, then the machine can reduce speed and then stop, or stop and be moved slowly (jogged) until the coin drops through the appropriate sorting aperture, where it is detected by the conventional coin count sensors.

One object of the present invention is to use an optical imaging system in place of the prior art mechanical sensors.

Another object of the invention is to provide a sorter for coin detection and bag stopping that does not utilize an encoder for tracking coins.

Another object of the present invention is to provide an enhanced type of contactless coin sensor assembly for both coin counting for bag stopping and detection of invalid coins for offsorting.

While the present invention is disclosed in a preferred embodiment based on Zwieg et al., U.S. Pat. No. 5,992,602, the invention could also be applied as a modification to other types of machines, including the other prior art described above.

The invention provides exact bag stopping for a high speed coin sorter.

Other objects and advantages of the invention, besides those discussed above, will be apparent to those of ordinary skill in the art from the description of the preferred embodiments which follow. In the description, reference is made to the accompanying drawings, which form a part hereof, and which illustrate examples of the invention. Such examples, however, are not exhaustive of the various embodiments of the invention, and therefore, reference is made to the claims which follow the description for determining the scope of the invention.

BRIEF DESCRIPTION OF THE DRAWINGS

FIG. 5A is sectional view in elevation of the brake seen in FIG. 4;

FIG. 5B is a detail sectional view taken in plane indicated by line 5B—5B in FIG. 5C.

FIG. 5C is a detail sectional view taken in plane indicated by line 5C—5C in FIG. 5A.

DETAILED DESCRIPTION OF THE PREFERRED EMBODIMENTS

Figure 1:
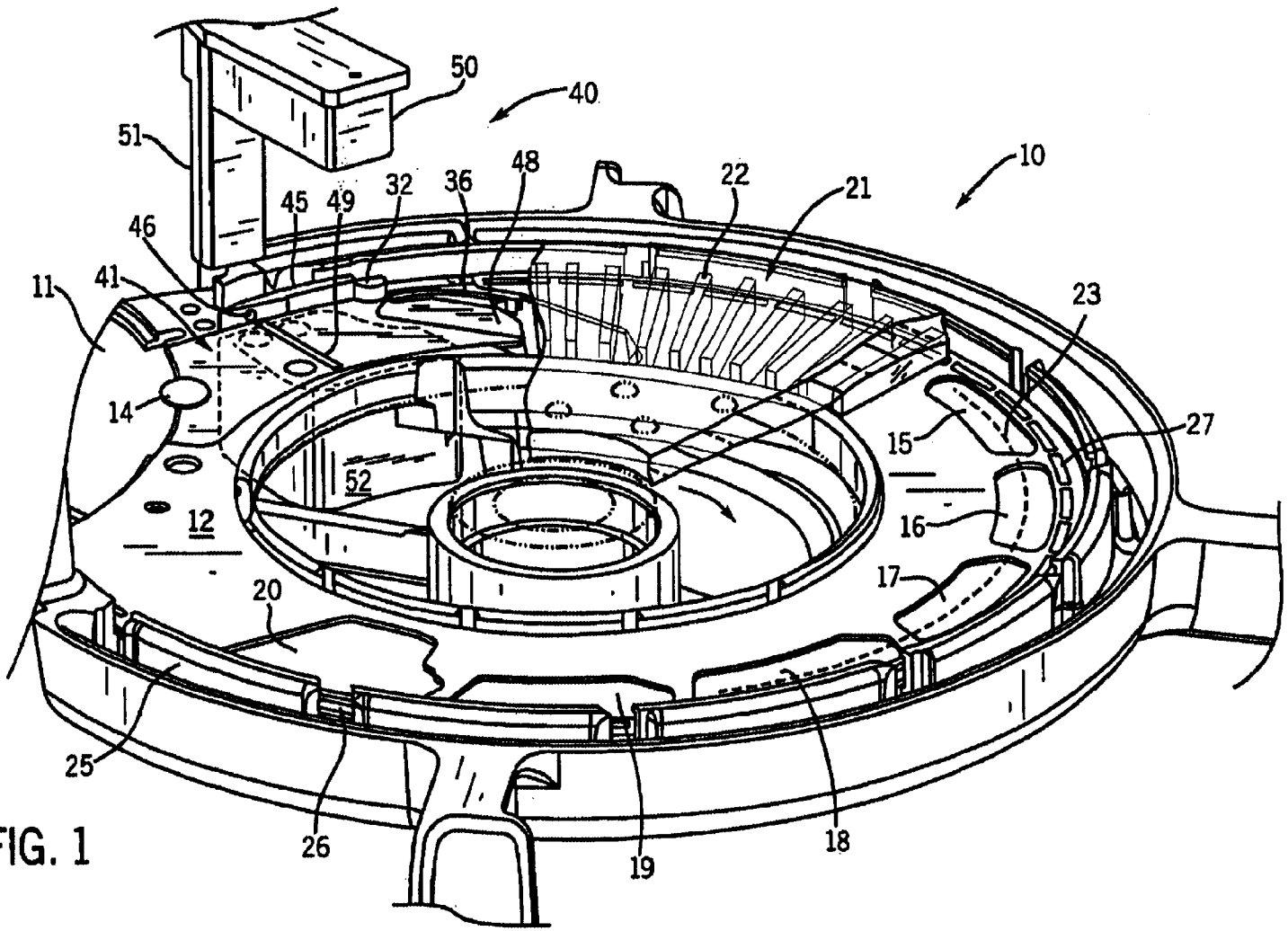
FIG. 1 is a perspective view of a portion of the coin sorter incorporating the present invention.
Figure 2:
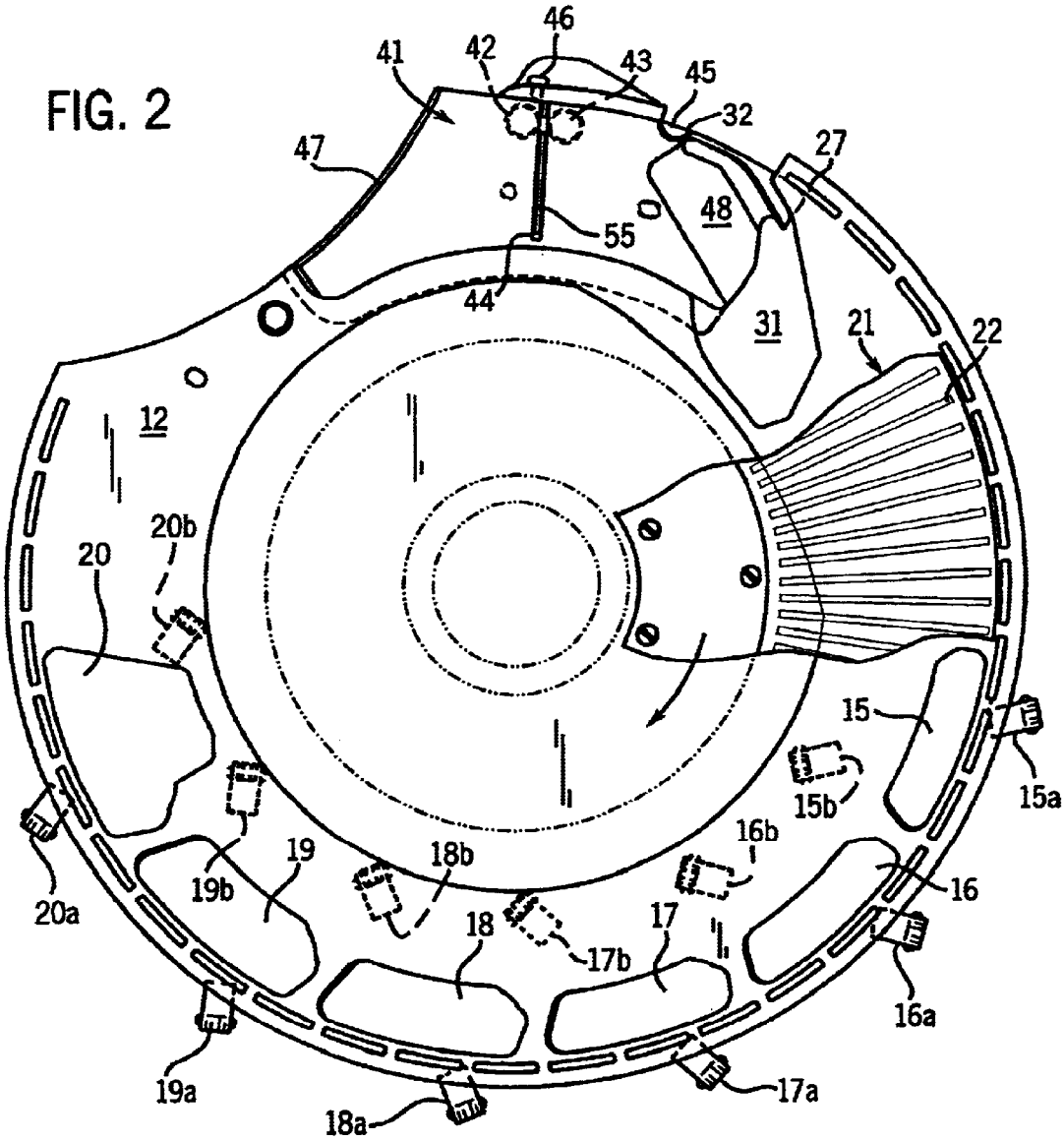
FIG. 2 is top plan view of a sorter plate in the coin sorter of FIG. 1.

Referring to FIG. 1, the coin handling machine 10 is a sorter of the type shown and described in Zwieg et al., U.S. Pat. No. 5,992,602, and offered under the trade designation, "Mach 12" by the assignee of the present invention. This type of sorter 10, sometimes referred to as a figure-8 type sorter, has two interrelated rotating disks, a first disk operating as a queueing disk 11 to separate the coins from an initial mass of coins and arrange them in a single file of coins 14 to be fed to a sorting disk assembly. The sorting disk assembly has a lower sorter plate 12 with coin sensor station 40, an offsort opening 31 (see FIG. 2) and a plurality of sorting apertures 15, 16, 17, 18, 19 and 20. There may be as many as ten sorting apertures, but only six are illustrated for this embodiment. The first five sorting apertures are provided for handling U.S. denominations of penny, nickel, dime, quarter and dollar. The sixth sorting opening can be arranged to handle half dollar coins or used to offsort all coins not sorted through the first five apertures.

As used herein, the term "apertures" shall refer to the specific sorting openings shown in the drawings. The term sorting opening shall be understood to not only include the apertures, but also sorting grooves, channels and exits seen in the prior art.

The sorting disk assembly also includes an upper, rotatable, coin driving member 21 with a plurality of webs 22 or fingers which push the coins along a coin sorting path 23 over the sorting apertures 15, 16, 17, 18, 19 and 20. The coin driving member is a disk, which along with the webs 22, is made of a light transmissive material, such as acrylic. The webs 22 are described in more detail in Adams et al., U.S. Pat. No. 5,525,104, issued Jun. 11, 1996. Briefly, they are aligned along radii of the coin driving member 21, and have a length equal to about the last 30% of the radius from the center of the circular coin driving member 21. rail formed by a thin, flexible strip of metal (not shown) is installed in slots 27 to act as a reference edge against which the coins are aligned in a single file for movement along the coin sorting path 23. As the coins are moved clockwise along the coin sorting path 23 by the webs or fingers 22, the coins drop through the sorting apertures 15, 16, 17, 18, 19 and 20. according to size, with the smallest size coin dropping through the first aperture 15. As they drop through the sorting apertures, the coins are sensed by photo emitters in the form of light emitting diodes (LEDs) 15*a*, 16*a*, 17*a*, 18*a*, 19*a* and 20*a* (FIG. 2) and optical detectors 15*b*, 16*b*, 17*b*, 18*b*, 19*b* and 20*b* (FIG. 2) in the form of phototransistors, one emitter and detector per aperture. The photo emitters 15*a*, 16*a*, 17*a*, 18*a*, 19*a* and 20*a* are mounted outside the barriers 25 seen in FIG. 1 and are aimed to transmit a beam through spaces 26 between the barriers 25 and an angle from a radius of the sorting plate 21, so as to direct a beam from one corner of each aperture 15, 16, 17, 18, 19 and 20 to an opposite corner where the optical detectors 15*b*, 16*b*, 17*b*, 18*b*, 19*b* and 20*b* (FIG. 2) are positioned.

As coins come into the sorting disk assembly 11, they first pass a coin sensor station 40 (FIG. 1). In the prior art, this station 40 was used to detect coin denominations using an inductive sensor, as well as to detect invalid coins. Invalid coins were then off-sorted through an offsort opening 31 with the assistance of a solenoid-driven coin ejector mechanism 32 (FIGS. 1, 2 and 7) having a shaft, which when rotated, directs a coin to an offsort edge 36 and ultimately to offsort opening 31. This offsorting of coins occurs in the same place, however, the present embodiment utilizes a different type of coin validity sensing at coin sensor station 40.

The coin sensor station includes a coin path insert 41. This coin path insert 41 is preferably made of a nonmagnetic material, for example, a zirconia ceramic, so as not to interfere with inductive sensors to be described. Two inductive sensors 42, 43 (shown in phantom in FIGS. 1 and 2) are inserted from the bottom of the coin path insert 41. One sensor 42 is for sensing the alloy content of the core of the coin, and another sensor 43 is for sensing the alloy content of the surface of the coin. This is especially useful, for U.S. coins of bimetal clad construction. The two inductive sensors 42, 43 are inserted on opposite sides of a radially aligned slit 44, which is used for the optical image detector to be described. The slit 44 is preferably filled or covered by a light transmissive, sapphire window element 49.

The coin path insert 41 also has a curved outside rail 45 for guiding the coins. A thickness and edge alloy inductive sensor 46 is embedded in this rail 45 so as not to project into the coin sorting path 23. The operation of the sensors 42, 43 and 46 relates to detection of invalid coins for offsorting.

The coin path insert 41 has a curved edge 47 on one end for interfacing with the queueing disk, and a sloping surface 48 at an opposite end leading to the offsort opening 31.

A housing shroud 50 (FIG. 1) is positioned over the window element 49, and this shroud 50 contains an optical source provide by a staggered array of light emitting diodes (LED's) 54 (FIG. 6A) for beaming down on the coin path insert 41 and illuminating the edges of the coins 14 as they pass by (the coins themselves block the optical waves from passing through). The optical waves generated by the light source may be in the visible spectrum or outside the visible spectrum, such as in the infrared spectrum. In any event, the terms "light" and "optical waves" shall be understood to cover both visible and invisible optical waves.

The housing cover 50 is supported by an upright post member 51 of rectangular cross section. The post member 51 is positioned just outside the coin sorting path 23, so as to allow the elongated optical source 54 to extend across the coin sorting path 23 and to be positioned directly above the elongated slit 44.

Figure 3:
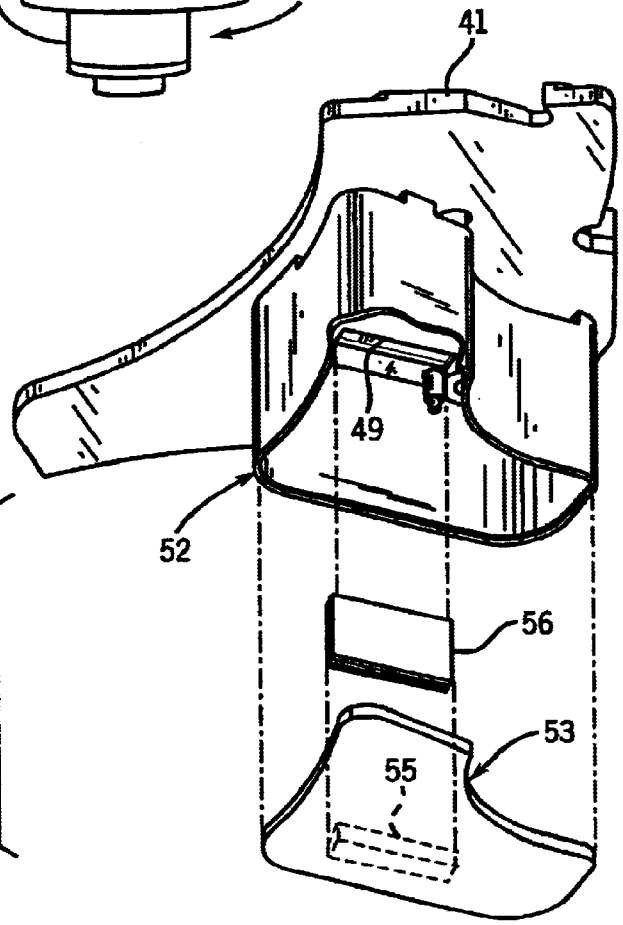
FIG. 3 in an exploded detail view of the optical sensor assembly in the coin sorter of FIG. 1.

Underneath the coin path insert 41 is a housing 52 (FIG. 1) of aluminum material for containing a coin sensing module (FIG. 3). As used herein, the term "circuit module" shall refer to the combination of circuit packages and the electronic circuit board upon which the circuit packages are mounted to form an electronic circuit. As seen in FIG. 3, the housing 52 has a body, with a body cavity, and a cover (which has been removed) enclosing the body cavity.

The circuit module 53 supports a linear array 55 of photodetector diodes, such that when the circuit module 53 is positioned properly in the housing 52 (FIG. 3) (the shape of the circuit module 53 is keyed to the shape of the housing 52), the linear array 55 will be positioned below the window 49. A linear lens array 56 is disposed between the window 49 and the photodiode array 55 to beam the light from the slit 49 to the photodiode array 55, and also to diffuse concentrations of light from the LEDs 54.

Figure 4:
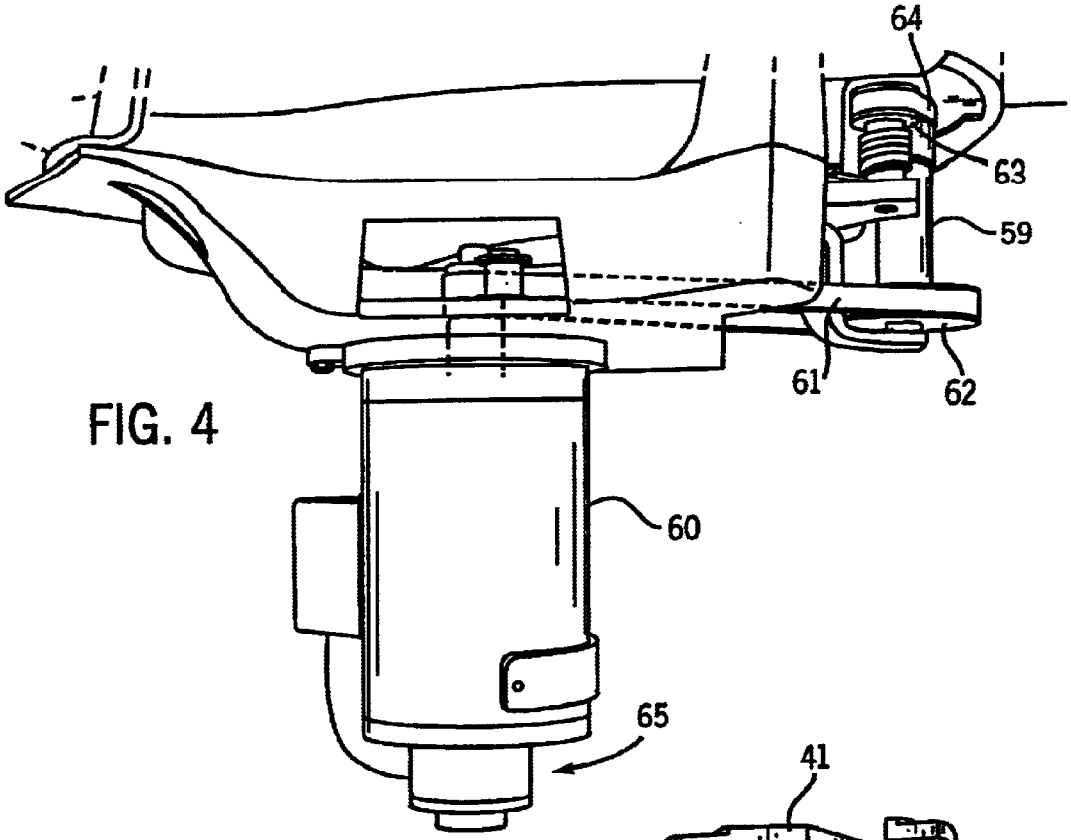
FIG. 4 is a side view in elevation of a bottom portion of the coin sorter of FIG. 1 showing a motor and a brake.

FIGS. 4 and 5 show a DC electric motor 60 for driving the two moving disks in the coin sorter 10. The motor 60 is connected through a belt 61 to a rotatable transfer shaft 59 with one pulley 62 being driven by belt 61 and a second pulley 63 for transferring power to a second belt 64 directly driving coin driving member 21 and the driving member 11 in the queueing portion of the machine 10. An electromechanical brake 65 is mounted to the bottom of the motor 60. The brake 65 is used for bag stops and emergency stops, while dynamic or regenerative braking is used for all types of stops.

Referring next to FIG. 5A, the brake 65 has a coil 66 which is bolted to a lower end of the motor 60 and receives an electrical "brake on" signal for braking. A collar 68 is fastened by a bolt to a lower end of a motor output shaft 67.

The collar 68 is connected to brake shoe 69 by leaf springs 70 and screws 71, which allows controlled separation of the collar 68 and brake shoe 69 in a direction parallel to the axis of rotation for the motor shaft 67. When a braking signal is sent to coil 66, it will cause frictional braking of the motor 60.

Figure 6A:
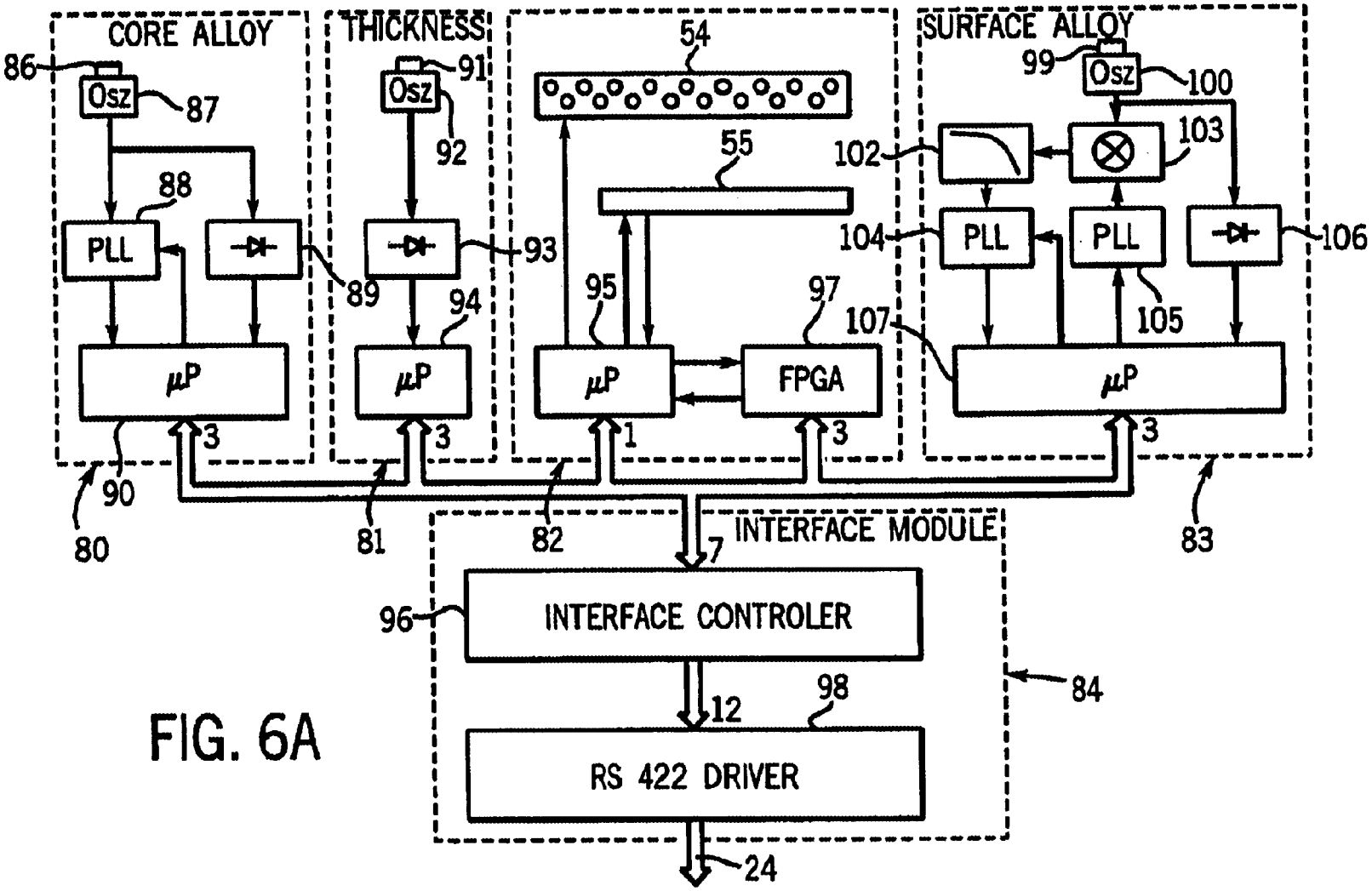
FIG. 6A is a block diagram of the sensor circuit module seen in FIG. 3.

FIG. 6A shows the details of a sensor circuit module 53 including five (5) sub-modules 80, 81, 82, 83 and 84 each an embedded microcontroller.

Figure 6B:
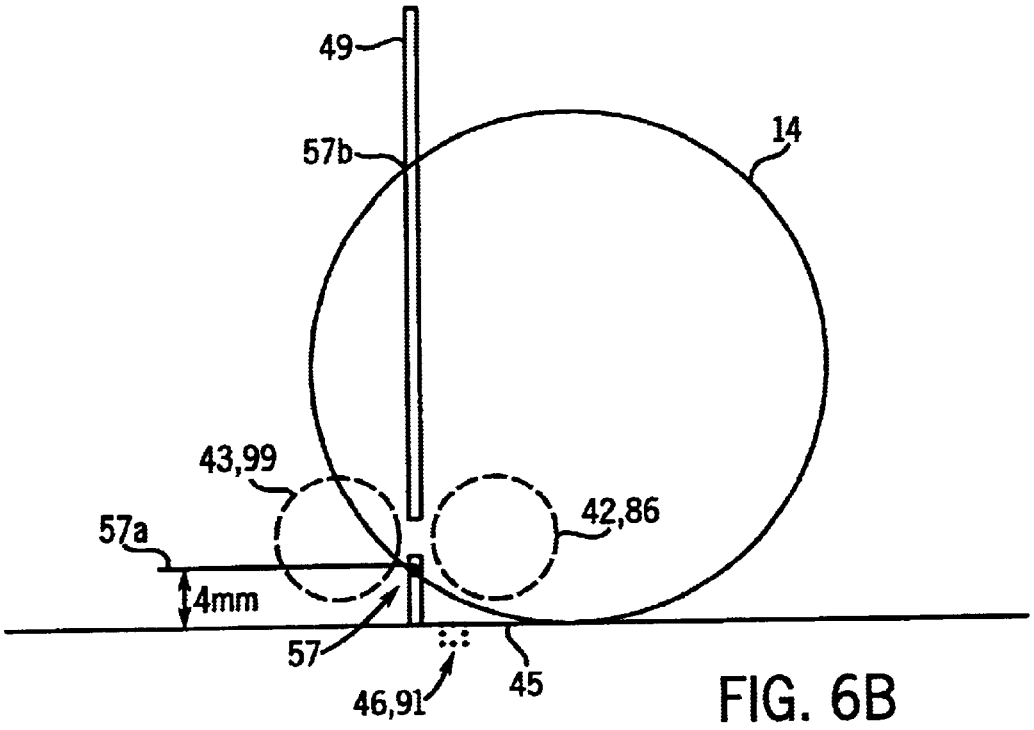
FIGS. 6B and 6C are enlarged detail diagrams of a coin passing through the sensor assembly of FIG. 3.

A core alloy detector sub-module 80 utilizes a 9.3 mm sensing coil 86 embedded in the sensor 42 and coupled to an oscillator 87 operating at 180 kHz. As a coin enters the field of the coil (see FIG. 6A), the oscillator impedance is altered by the eddy currents developed in the coin, resulting in both frequency and voltage changes. The frequency is measured by a phase locked loop (PLL) circuit 88 acting as a frequency to voltage converter. The phase locked loop circuit 88 acts to respond very quickly to frequency changes. The voltage of the oscillator is measured by rectifying the sine wave through rectifier circuit 89 and reading it with an analog to digital (A/D) converter integrated with a microcontroller 90. The microcontroller is preferably a PIC 16C715 microcontroller available from Microchip Technology, Inc., Chandler, Ariz., USA. The reading of the coin alloy data occurs when the coin fully covers the sensor coil 86 as determined by a diameter sensor trigger point 57, illustrated in FIG. 6B. Therefore, the reading is taken relative to a specific position in the coin path 23. Values for the voltage and frequency are transferred to the coin sensor module interface controller 84.

A thickness/edge alloy detector sub-module 81 (FIG. 6A) provides a single data output as a function of both coin thickness and alloy composition. A 3.3 mm sensing coil 91 is mounted in sensor 46 in the side rail 45 (FIG. 1) along the coin path 23 with the active field perpendicular to the core alloy detector 42. The sensor coil 91 (FIG. 6A) oscillates at 640 kHz as provided by oscillator 92. As a coin to be tested approaches (FIG. 6B), the presence of the coin material changes the impedance of the oscillator 92. The output of the oscillator 92 is rectified by a diode rectifier circuit 93 and sampled many times by an analog-to-digital converter integrated into a second microcontroller 94, which may be of the same type as microcontroller 90. When the maximum influence (lowest output) of a coin is determined, the value is transmitted to coin sensor module interface controller 84. optical diameter sensor module 82 forms a closed loop system controlled by a microcontroller 95, similar to microcontrollers 90 and 94. The illumination source, comprised of multiple LED's 54 in a staggered pattern (FIG. 6A), illuminates the coin sensing area with light energy which in turn is detected by the photodiode array 55, which provides a 1×768 pixel array below the coin path insert 41. The light waves are emitted through the light transmissive drive member 21, and the sapphire window 49 flush with the coin path insert 41. The intensity of the light source 54 is controlled by the programmed microcontroller 95 to compensate for degradation due to aging or contamination. A dual comparator method is used to differentiate between the gradual transition of webs 22 on the drive member 21 and the abrupt transition of the coin edge.

When the shadow of a coin 14 covers the trigger point 57 (FIG. 6B) of the linear detection array 55, readings will taken between a first light-to-dark transition 57*a* and a first dark-to-light transition 57*b*. When the shadow of the coin covers trigger point 58 (FIG. 6C), readings will be taken between a second light-to-dark transition 58*a* and a second dark-to-light transition 58*b*. These readings are taken inward from the exact leading edge and trailing edge of the coin 14 in the event that the coin has nicks in the leading and trailing edge that would skew the data.

The distance between these events is the radius of the coin for that sample. Multiple samples are taken until the coin passes the maximum diameter point. The sample readings are averaged and the resulting data are transferred to the sensor module interface controller 84. The multiple samples minimize the effect of nicked or non-round edges. Coins or tokens with a center hole will also be correctly identified because only certain transitions are considered valid.

The microcontroller CPU 95 reads imaging data from a field programmable gate array (FPGA) 97, which connects to the (number of elements) photodiode array 55 through the CPU 96. The FPGA 97 receives and interprets pixel imaging signals from photodiode array 55 which are then read by the microcontroller CPU 95, and used to calculate the diameter of each coin as it passes the window 49. The photodiode array 55 does not necessarily span the full diameter of each coin, and an offset may be used to calculate the full diameter. While diameter data is used in this embodiment, it should be apparent that radius data is an equivalent that could also be used and then multiplied by two when necessary. The term "dimensional data" shall include both diameter data and other data from which coin size can be derived. The diameter data is then communicated to the second microcontroller CPU 96.

Figure 6C:
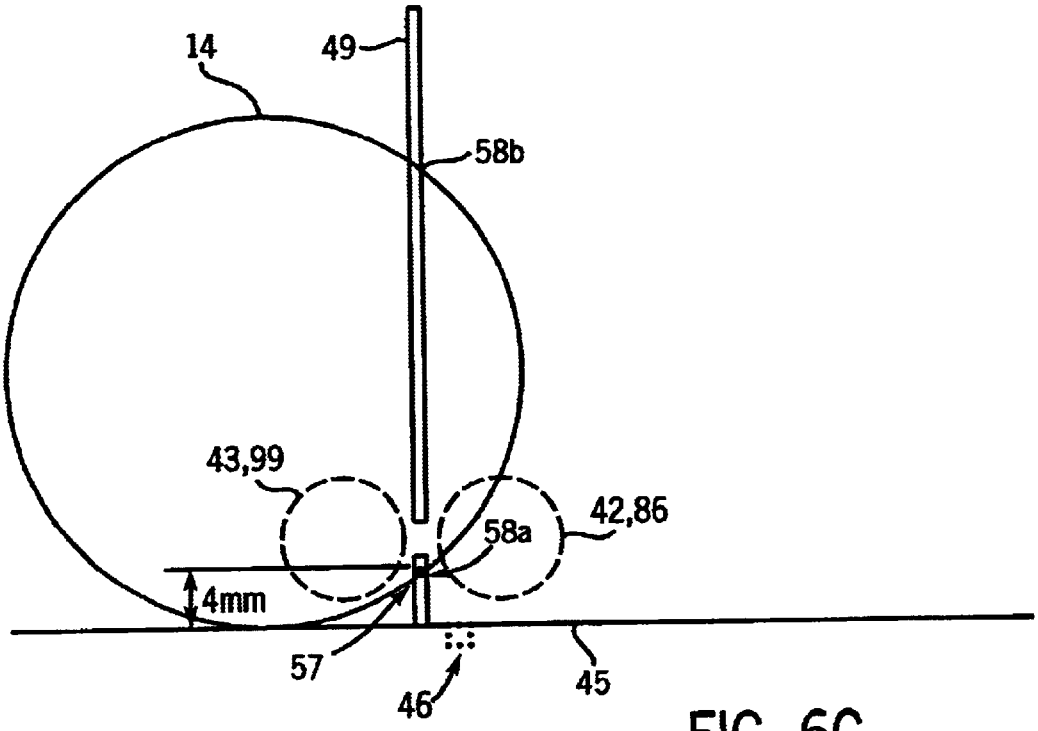

A surface alloy detector sub-module 83 includes a 9.3 mm sensing coil 99, which oscillates at a nominal frequency of 1 MHz as provided by oscillator 100. Two phase locked loop devices 104, 105 are used, one to reduce the frequency, the other to measure the frequency. A summing circuit 103 and a fourth order filter 102 are used in one of the loops. A voltage representing a magnitude of the sensed signal is obtained by rectifying the sine wave with diode rectifier circuit 106 and reading the result with an analog-to-digital converter included in a microcontroller 107. This microcontroller is a PIC 16C72 microcontroller available from Microchip Technology, Inc., of Chandler, Ariz., USA. The reading of the coin alloy data occurs when the coin fully covers the sensor 43 and sensor coil 99 as determined by the sensor trigger point 58 (FIG. 6C). Therefore, the reading is taken relative to a specific position in the coin path 23. Values for the voltage and frequency are then transferred to an interface controller module 84 for the sensor module 53.

Figure 7:
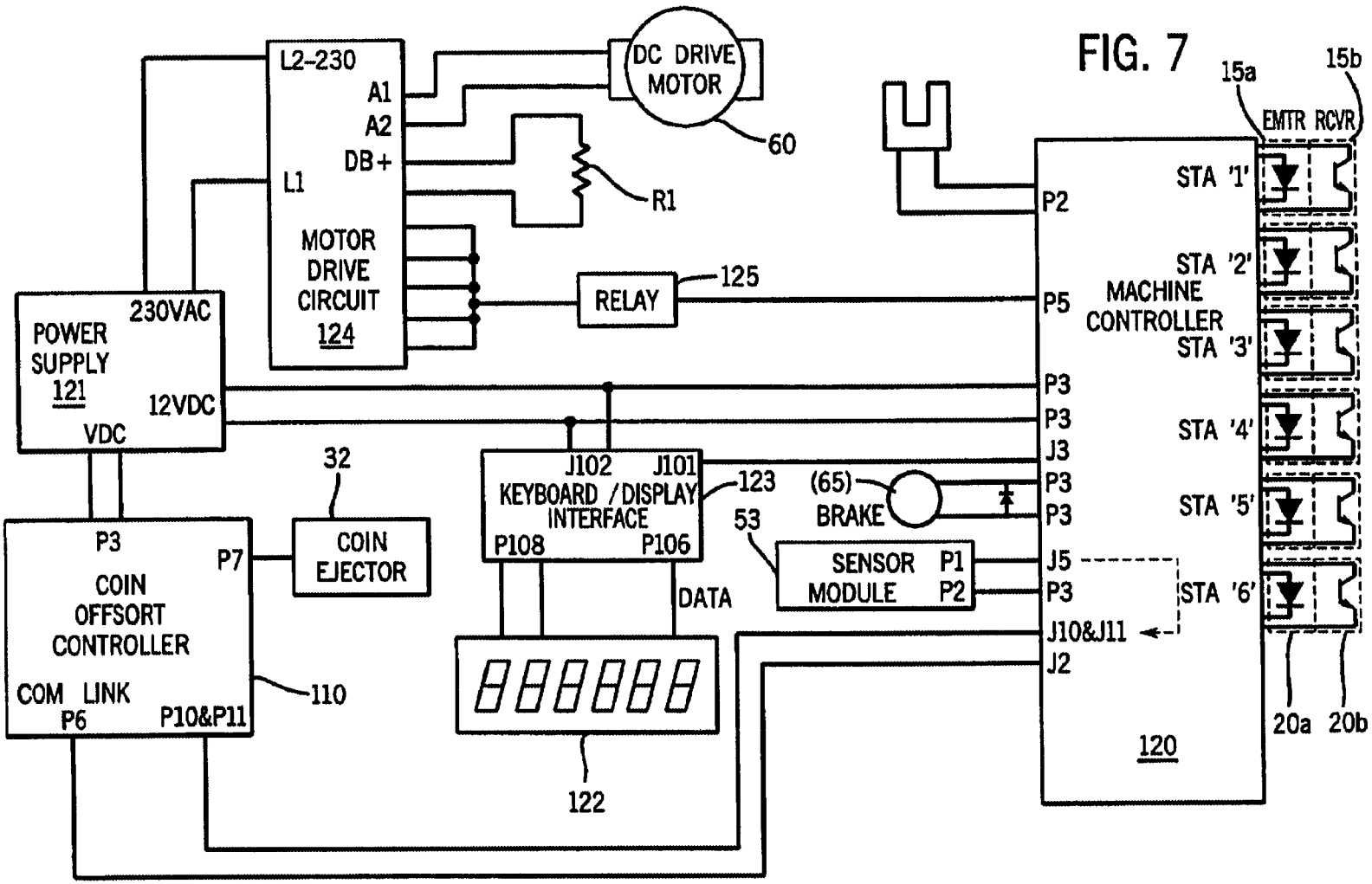
FIG. 7 is a schematic of the overall electrical control system of the sorter of FIG. 1.

The interface controller module 84, includes a microcontroller CPU 96 for reading the core voltage, core frequency, thickness, diameter, surface voltage and surface frequency data from the other detector modules 80, 81, 82 and 83 and transmitting the data to the coin off sort controller module 110 in FIG. 7. The interface controller 96 is preferably a PIC 16C72 microcontroller circuit available from Microchip Technology, Inc., of Chandler, Ariz., USA. Other CPU microcontrollers may be used for the microcontrollers described above in the sub-modules 80–84. The interface microcontroller CPU 96 connects to a coin off sort controller module 110 (FIG. 7) through an interrupt request line (IRQ), a three-bit address bus, an eight-bit data bus and a set of line drivers 98.

Figure 6D:
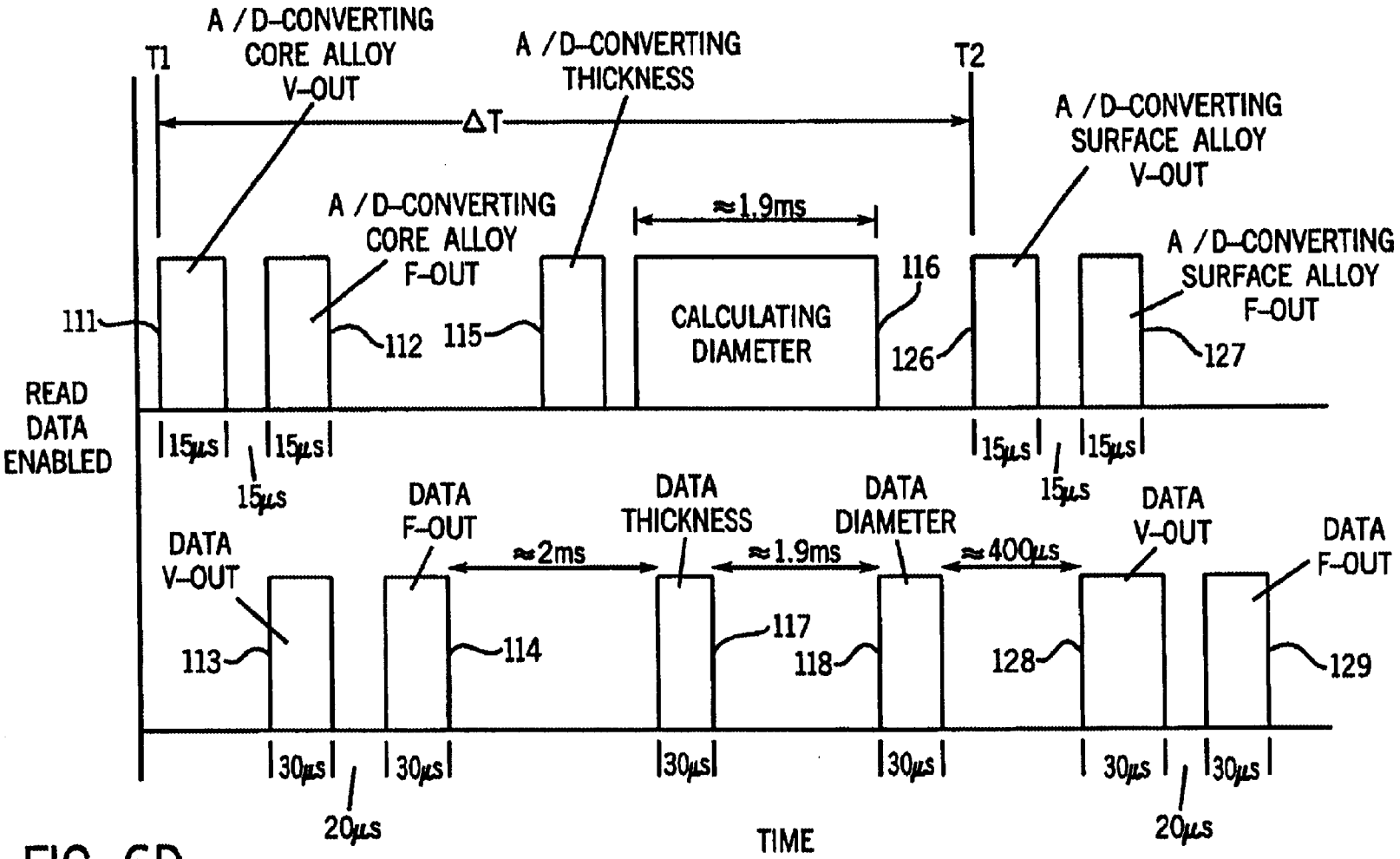
FIG. 6D is a timing diagram of the operation of the sensor circuit module of FIG. 6A.

The manner in which the integrate controller 96 reads data from the sub-modules 80, 81, 82 and 83 is illustrated in the timing diagram of FIG. 6D. First, the data for magnitude and frequency from the core alloy sensor 42 is read into sub-module 80 in 15-microsecond intervals 111, 112 beginning at trigger point 57 in FIGS. 6B and 6C (T1 in FIG. 6D). Then, the data from the core alloy sensor 42 is read by the interface controller 96 in 30-microsecond intervals 113, 114, separated by a 20-microsecond interval. Next, the data from this edge alloy thickness sensor 46 is read into sub-module 81 in interval 115, and then the coin passes over the imaging sensor 54, 55, such that size readings are read by sub-module 82 and the diameter is calculated in time frame 116. The interface controller 96 then reads in the data for data thickness and coin size in time frames 117, 118. The order of these two qualities, coin edge data and coin size data, could be reversed between themselves, but would still follow the core alloy sensing data. Lastly, as the coin passes the surface alloy sensor and the second trigger point 58 in FIGS. 6B and 6C (T2 in FIG. 6D), sub-module 83 reads in data in 15-microsecond intervals 126, 127 and the interface controller reads the surface alloy data for magnitude and frequency in 30-microsecond intervals 128, 129, separated by a 20-microsecond interval.

In one embodiment of the present invention, the sensors 42, 43 and 46 for checking validity of coins for offsorting purposes are not used. Only the photodiode array 55 for detecting the diameter of each coin is used for sensing coins passing the coin path insert 41. In this simplified embodiment, a coin off sort controller module 110 (FIG. 7) is not necessary, and the data from the coin sensor module 53 is directly to a main machine controller CPU module 120 seen in FIG. 7 through a three-bit address bus and an eight-bit data bus and a set of line drivers, designated as Port 2. In the embodiment in which the sensors 42, 43 and 46 are used in the sensor module 53, the coin sensor module 53 communicates through Port 1 (P1) and a feed-through connection on the main controller CPU 120 (J10–J11 connecting to P10–P11 on the coin off sort controller module).

Referring to FIG. 7, the machine controller CPU 120 has six I/O ports (STA 1–STA 6) for sending output signals to the light emitting diodes 15*a*, 16*a*, 17*a*, 18*a*, 19*a* and 20*a* and receiving signals from the optical detectors 15*b*, 16*b*, 17*b*, 18*b*, 19*b* and 20*b* for the six sorting apertures. The main controller CPU 120 thereby detects when coins fall through each sorting aperture 15–20 and can maintain a count of these coins for totalizing purposes. By "totalizing" is meant the counting of coin quantities and monetary value for purposes of informing a user through a display, such as LED readout display 122, which is interfaced with a keyboard through interface 123 to the main controller CPU 120.

The main controller CPU 120 is interfaced through electronic circuits to control the DC drive motor 60. In particular, the main controller CPU 120 is connected to operate a relay 125 which provides an input to an electronic motor drive circuit 124. This circuit 124 is of a type known in the art for providing power electronics for controlling the DC motor 60. This circuit 124 receives AC line power from a power supply circuit 121. The motor drive circuit 124 is also connected to a dynamic braking resistor R1 to provide regenerative motor braking for the DC motor 60.

The coin off sort controller module 110 includes a microelectronic CPU, such as an Intel 8051, as well as the typical read only memory, RAM memory, address decoding circuitry and communication interface circuitry to communicate with the sensor control module 53 and the main controller CPU 120 as shown in FIG. 7. The coin off sort controller module 110 is connected to operate the coin ejector mechanism 32, an invalid coin is sensed at coin sensing station 40.

Figure 8:
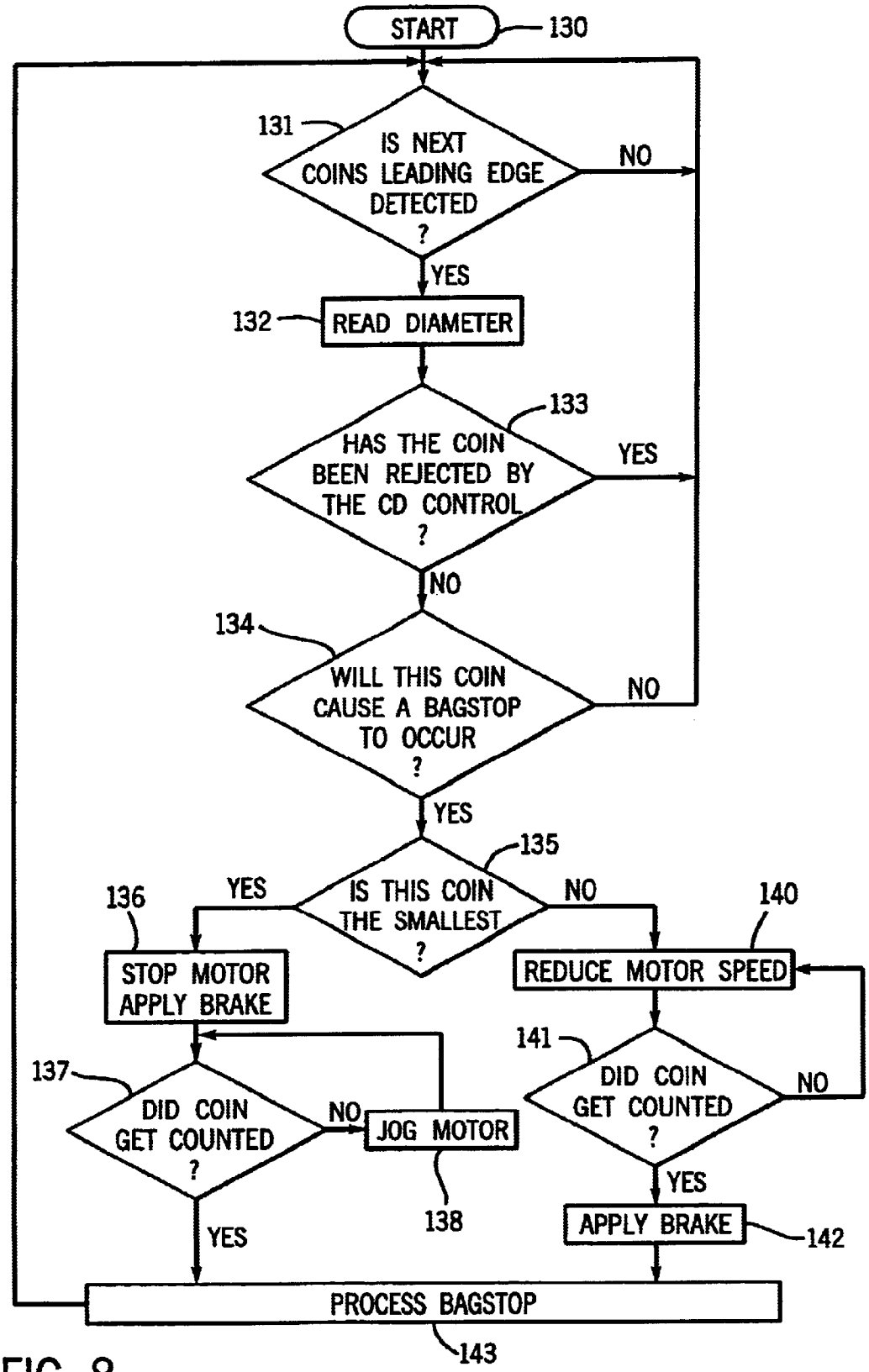
FIG. 8 is a flow chart of operation of the main controller of FIG. 7.

Referring next to FIG. 8, the operation of the main controller CPU module 120 in braking the coin driving member 21 in response to reaching a bag stop limit is charted. This start of this portion of the program of the respective CPU 120 is represented by the start block 130. The coin sensor module 53 indicates the detection of the leading edge of a next coin, thereby signaling to the main controller CPU 120 that a diameter for the preceding coin is now ready for upload, along with five bytes of data concerning coin validity, including a thickness byte resulting from signals from thickness sensor 46 and frequency and magnitude bytes resulting from signals from each of the alloy sensors 42, 43. The data is the uploaded as represented by process block 132.

The main controller CPU 120 processes this data to determine if the coin should be rejected, as represented by decision block 133. If the answer is "YES" as represented by the "YES" branch from decision block 133, the program returns to block 131 to process the next coin. If the answer is "NO" as represented by the "NO" branch from decision block 133, the coin is added to the count for the respective denomination and compared to the count for a bag stop limit number, as represented by process block 134. If a bag stop is determined, as represented by the "YES" result from decision block 134, the main controller CPU 120 executes program instructions to determine if this is the "smallest" denomination representing the closest sorting aperture. It should be appreciated here that if the sorting openings were other than apertures in a flat surface, then the order of denominations might be reversed with the largest coin being sorted first. In any event, it is the sorting aperture closest to the coin sensor station 40 that provides the shortest stopping distance.

If this answer is "YES" as a result of executing the decision in decision block 135, then the main controller CPU 120 transmits a signal to apply the brake 65 to stop the motor 60 in ths shortest time and corresponding distance of movement of the coin driving member 21 as represented by process block 136. Next, as represented by decision block 137, the main controller CPU executes program instructions to determine if the coin was detected as it passed one of the optical detectors 15*b*, 16*b*, 17*b*, 18*b*, 19*b* or 20*b*. When this has occurred, the last coin has been sorted and presumably passed to the bag or receptacle to provide the exact bag stop. If in executing decision block 137, the result is "NO," then the main controller CPU 120 issues a command (process block 138) to move the motor forward at low speed ("jog") the motor 60, and then executes program instructions represented by decision block 137 to see if the coin has been sorted into the bag. At that time the motor 60 is stopped, and the operator is signaled through a visual or audible alarm, or both, to replace the filled bag with an empty bag and restart the machine 10, as represented by process block 143. The CPU 120 then loops back to re-execute the steps seen in FIG. 8 for the next coin.

In the event that the answer in decision block 135 is "NO," meaning the denomination does not correspond to the sorting aperture 15 closest to the sensing station 40, the main controller CPU 120 transmits a signal to the motor control circuit 124 to slow the motor by regenerative braking through resistor R1 to a predetermined slower speed than full operating speed, and this is represented by process block 140 in FIG. 8. The CPU 120 then executes program instructions, as represented by decision block 141, to determine if the coin was detected as it passed one of the optical detectors 15*b*, 16*b*, 17*b*, 18*b*, 19*b* or 20*b*. If the answer is "NO" it loops back to process block 140 to further reduce motor speed and then re-executes decision block 141. When the coin is detected, as represented by the "YES" result, the CPU 120 transmits signals through motor control circuit 124 to operate the brake 65 to brake the motor 60, as represented by process block 142. At that time the motor 60 is stopped, and the operator is signaled through a visual or audible alarm or both to replace the filled bag with an empty bag and restart the machine 10, as represented by block 143. completes the description of a method and apparatus for utilizing optical imaging to rapidly count coins before they are sorted, and upon reaching a bag stop limit, either reducing speed or stopping a motor that causes movement of the coins in a coin sorting machine.

This has been a description of the preferred embodiments of the method and apparatus of the present invention. Those of ordinary skill in this art will recognize that still other modifications might be made while still coming within the spirit and scope of the invention and, therefore, to define the embodiments of the invention, the following claims are made.

We claim:

1. A method of counting coins in a batch of coins for bag stopping, the method comprising:

a first sensing of each coin of a plurality of mixed denominations of coins at a first location in advance of sorting openings for sorting the coins, said first sensing being an optical measuring of a size of each coin as each coin passes the first location and in response to said first sensing, generating coin dimensional data for each respective coin;

using the coin dimensional data for counting the coins by denomination up to a bag stop limit for one of the denominations, wherein one of the coins thus counted is a bag stop limit coin which is one of the last five coins of a denomination to be discharged into a bag before the movement of the coins along the coin path is to be stopped;

wherein said first sensing and counting for bag stopping is accomplished before said coins enter the sorting openings which provide the sorting of the coins from the plurality of mixed denominations;

reducing speed of a coin driving member to slow movement of the coins when said optical measuring produces data indicative of a bag stop limit being reached for a respective denomination; and a second sensing of the bag stop limit coin after traveling a distance from the first location and entering a respective sorting opening, said second sensing confirming that the bag stop limit coin has reached a location for discharge to a bag.

2. The method of claim 1, wherein the speed of movement of the coin driving member is reduced by braking a motor to a stop in the shortest distance upon detection of a bag stop limit coin of the denomination which enters a sorting opening which is closest to the first location for sensing coins.

3. The method of claim 1, the speed of movement of the coin driving member is reduced by reducing the speed of the motor to a lower speed and then braking the motor to a stop upon detection of a bag stop limit coin of the denomination for a sorting opening further downstream than the sorting opening closest to the first location for sensing coins.

4. The method of claim 1, wherein the sensing of each coin at the first location is carried out by directing optical waves from one side of a coin path through the coin path and detecting light or shadow on an opposite side of the coin path.

5. The method of claim 1, wherein the sensing of each coin at the first location is carried out by directing optical waves through a coin driving member as it moves the coins along a coin sorting path prior to sorting.

6. The method of claims 4 or 5, wherein the optical waves have a frequency in an infrared frequency range.

7. The method of claim 1, wherein the bag stop limit is exactly the limit of coins for a bag of coins.

8. The method of claim 1, further comprising a third sensing of the coins as they move past the first location along the coin path, said third sensing including sensing the alloy qualities of a core and a surface of a coin, and processing results of said third sensing for offsorting invalid coins prior to sorting.

9. The method of claim 1, wherein said dimensional data is data specifying coin diameter.

10. The method of claim 1, wherein said coins are moved along an arcuate coin path to the sorting openings.

11. A coin handling machine for executing a bag stop limit, the coin handling machine further comprising:

a first coin sensor located at a first location along a coin path where a plurality of coins of mixed denomination are moved by a coin driving member, said first location being in advance of entry into the sorting openings for sorting the coins by denomination, said first coin sensor transmitting data for identifying and counting the coins of mixed denomination for bag stopping before said coins have left the plurality of coins of mixed denomination and before said coins have entered into the sorting openings;

a controller for receiving said data from the first sensor and for counting the coins by denomination up to a bag stop limit for one of the denominations, wherein one of the coins thus counted is a bag stop limit coin which is one of the last five coins of a denomination to be discharged into a bag before the movement of the coins along the coin path is to be stopped;

said controller transmitting signals to at least reduce the speed of the driving member when a bag stop limit coin is detected for a respective denomination; and second coin sensors disposed at second locations to detect coins passing through the sorting openings for counting the coins of respective denominations, one of said second coin sensors being operable for sending a signal to confirm that the bag stop limit coin has passed through a sorting opening.

12. The coin handling machine of claim 11, wherein said controller transmits a braking signal to stop the motor in the shortest distance upon detection of a coin of the denomination for a sorting opening closest to the coin sensor.

13. The coin handling machine of claim 11, wherein said controller transmits a braking signal to reduce the speed of the motor upon detection of a coin of the denomination corresponding to a sorting opening beyond a sorting opening closest to the coin sensor.

14. The coin handling machine of claim 11, wherein the coin driving member moves the coins along a coin sorting path and wherein the coin sorting member includes a portion positioned in the coin sorting path that is formed by a light transmissive material, wherein the first coin sensor includes an optical emitter positioned above the light transmissive portion of the coin sorting path, and wherein the first coin sensor includes an optical detector disposed below the portion of the coin sorting path formed of light transmissive material.

15. The coin handing machine of claim 14, wherein the coin driving member is made of a light transmissive material and is interposed between said light emitter and the portion of the coin sorting path formed of light transmissive material.

16. The coin handling machine of claim 15, wherein the coin driving member includes a planar disk member and webs formed along radii crossing the coin sorting path and positioned substantially vertical with respect to the coin sorting path, said webs having lower ends spaced less than a thickness of one coin from the coin sorting path so as to engage and move the coins along the coin sorting path, and wherein said coin sorting path is arcuate.

17. The coin handling machine of claims 14, 15 or 16, wherein the optical emitter emits an optical wave having a frequency in an infrared frequency range.

18. The coin handling machine of claim 11, wherein the bag stop limit is exactly the limit of coins for a bag of coins.

19. The coin handling machine of claim 11, further comprising third sensors assembled with said first coin sensor for sensing alloy qualities of a core and a surface of a coin as the coin is moved along the coin sorting path, and wherein the controller processes results of said sensing of alloy qualities for offsorting invalid coins prior to sorting.

20. The coin handling machine of claim 11, wherein said dimensional data is data specifying coin diameter.

* * * * *